US011795712B2

(12) United States Patent
Head

(10) Patent No.: US 11,795,712 B2
(45) Date of Patent: Oct. 24, 2023

(54) FALL ARREST ASSEMBLY

(71) Applicant: Daniel Head, Orleans (CA)

(72) Inventor: Daniel Head, Orleans (CA)

( * ) Notice: Subject to any disclaimer, the term of this patent is extended or adjusted under 35 U.S.C. 154(b) by 0 days.

(21) Appl. No.: 17/669,077

(22) Filed: Feb. 10, 2022

(65) Prior Publication Data

US 2023/0250654 A1 Aug. 10, 2023

(51) Int. Cl.
*E04G 21/32* (2006.01)
*A62B 35/00* (2006.01)

(52) U.S. Cl.
CPC ..... *E04G 21/3214* (2013.01); *A62B 35/0068* (2013.01)

(58) Field of Classification Search
CPC ..... A62B 35/0068; E04G 21/3214
See application file for complete search history.

(56) References Cited

U.S. PATENT DOCUMENTS 4,249,716 A 2/1981 Glynn
5,054,576 A * 10/1991 Glynn ..... E04G 21/3276 248/237
5,148,890 A * 9/1992 Sipe ..... E04G 3/26 52/749.1
5,248,021 A * 9/1993 Nichols ..... E04D 13/12 248/237
5,282,597 A * 2/1994 Babcock ..... E04D 13/12 248/237
5,287,944 A * 2/1994 Woodyard ..... E04D 13/12 248/237
5,346,036 A * 9/1994 Arisman ..... E04G 5/041 248/200.1
5,361,558 A 11/1994 Thornton
5,442,887 A * 8/1995 Welsh ..... E04B 7/045 52/93.2
5,553,685 A * 9/1996 Cook ..... A62B 35/0068 182/45
5,595,260 A * 1/1997 Jalla ..... E04G 21/3261 52/27
5,687,535 A * 11/1997 Rohlf ..... E04D 13/12 52/27
5,727,646 A * 3/1998 Gray ..... E04D 15/00 248/237
5,730,245 A * 3/1998 Conway ..... A62B 35/0068 182/45

(Continued)

FOREIGN PATENT DOCUMENTS

AT 519224 B1 * 5/2018 ..... A62B 35/0068
CA 19790063120 9/1982

(Continued)

*Primary Examiner* — Eret C McNichols

(57) ABSTRACT

A fall arrest assembly for anchoring a fall arresting line to a pair of roof trusses includes a truss mount that has a pair of channels each being integrated into the truss mount. The pair of channels is oriented parallel with respect to each other to insertably receive a beam of a respective one of a pair of roof trusses thereby mounting the truss mount to the pair of roof trusses. An anchor box is integrated into the truss mount and the anchor box has an anchor point which is integrated into the anchor box. In this way the anchor point can have a fall arresting line attached to the anchor point thereby facilitating the fall arresting line to be mounted to the pair of roof trusses.

11 Claims, 5 Drawing Sheets

(56) References Cited

U.S. PATENT DOCUMENTS

| | | | | |
|---|---|---|---|---|
| 5,829,203 | A | 11/1998 | Ealer, Sr. | |
| 5,896,719 | A * | 4/1999 | Thornton | E04G 5/041 52/27 |
| 6,729,083 | B1 * | 5/2004 | Soyko | E04D 13/0305 52/220.8 |
| 6,763,910 | B2 * | 7/2004 | Cole | E04G 21/3276 248/237 |
| 6,840,015 | B1 | 1/2005 | Ashley | |
| 6,868,647 | B2 * | 3/2005 | Poldmaa | E04D 13/12 52/749.12 |
| 7,163,083 | B2 * | 1/2007 | Argoud | E04G 21/3261 248/237 |
| D595,115 | S | 6/2009 | Royer | |
| 8,511,036 | B2 * | 8/2013 | O'Donnell | E04G 21/3276 52/712 |
| 8,573,360 | B1 * | 11/2013 | Yoder | E04G 3/265 52/749.12 |
| 8,746,402 | B2 * | 6/2014 | Nichols, Jr. | E04G 21/3276 248/237 |
| 9,248,323 | B1 * | 2/2016 | Larsen | A62B 35/0068 |
| 9,878,187 | B2 * | 1/2018 | Sargent | E04G 21/328 |
| 10,053,878 | B2 * | 8/2018 | Allen | A62B 35/0068 |
| 10,737,126 | B1 * | 8/2020 | Aleksovski | E04G 21/328 |
| 10,898,741 | B2 * | 1/2021 | Giroux | A62B 35/0068 |
| 11,118,363 | B1 * | 9/2021 | Allen | E04G 21/3219 |
| 2003/0006094 | A1 * | 1/2003 | Cole | A62B 35/0087 182/36 |
| 2003/0051429 | A1 * | 3/2003 | Hovenier | E04G 5/041 52/39 |
| 2005/0189171 | A1 * | 9/2005 | Bos | E04G 21/3276 182/36 |
| 2006/0156645 | A1 * | 7/2006 | Munday | A62B 35/0068 52/122.1 |
| 2013/0228394 | A1 * | 9/2013 | Sousa | E04G 21/3295 248/231.41 |
| 2015/0107184 | A1 * | 4/2015 | Nichols, Jr. | E04G 21/3276 52/698 |
| 2015/0211246 | A1 | 7/2015 | Sutherland | |
| 2016/0059054 | A1 * | 3/2016 | Csizmadia | E04G 21/328 248/548 |
| 2017/0157438 | A1 * | 6/2017 | Sargent | E04G 21/328 |
| 2017/0361135 | A1 * | 12/2017 | Crookston | A62B 35/0068 |
| 2020/0392748 | A1 * | 12/2020 | Fabbi | A62B 35/0087 |

FOREIGN PATENT DOCUMENTS

| | | | | |
|---|---|---|---|---|
| CH | 704527 | A1 * | 8/2012 | A62B 35/0068 |
| DK | 178036 | B * | 4/2015 | A62B 35/0068 |
| FR | 2832751 | A1 * | 5/2003 | A62B 35/0068 |

* cited by examiner

FALL ARREST ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fall devices and more particularly pertains to a new fall device for anchoring a fall arresting line to a pair of roof trusses. The device includes a truss mount which has a pair of channels integrated into the truss mount for engaging a pair of roof trusses. The device includes an anchor box that is attached to the truss mount and an anchor point that is integrated into the anchor box. The anchor point can have a fall arresting line attached to the anchor point.

(2) Description of Related Art Including Information Disclosed Under 37 CFR 1.97 and 1.98

The prior art relates to fall devices including a truss bracket that includes a triangular bracket that is fastenable to a peak of a roof and which has an anchor hole for receiving a fall arresting line. The prior art discloses a truss bracket that includes a pair of spaced legs for straddling a rafter and a member extending away from the spaced legs for engaging a fall arresting line. The prior art discloses a variety of fall arresting brackets that each has a pair of angled surfaces for mounting to a peak of a roof to anchor a fall arresting line. The prior art discloses a fall arresting box that is insertable into a framed opening in building framing and which includes an anchor point for anchoring a fall arresting line.

BRIEF SUMMARY OF THE INVENTION

An embodiment of the disclosure meets the needs presented above by generally comprising a truss mount that has a pair of channels each being integrated into the truss mount. The pair of channels is oriented parallel with respect to each other to insertably receive a beam of a respective one of a pair of roof trusses thereby mounting the truss mount to the pair of roof trusses. An anchor box is integrated into the truss mount and the anchor box has an anchor point which is integrated into the anchor box. In this way the anchor point can have a fall arresting line attached to the anchor point thereby facilitating the fall arresting line to be mounted to the pair of roof trusses.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
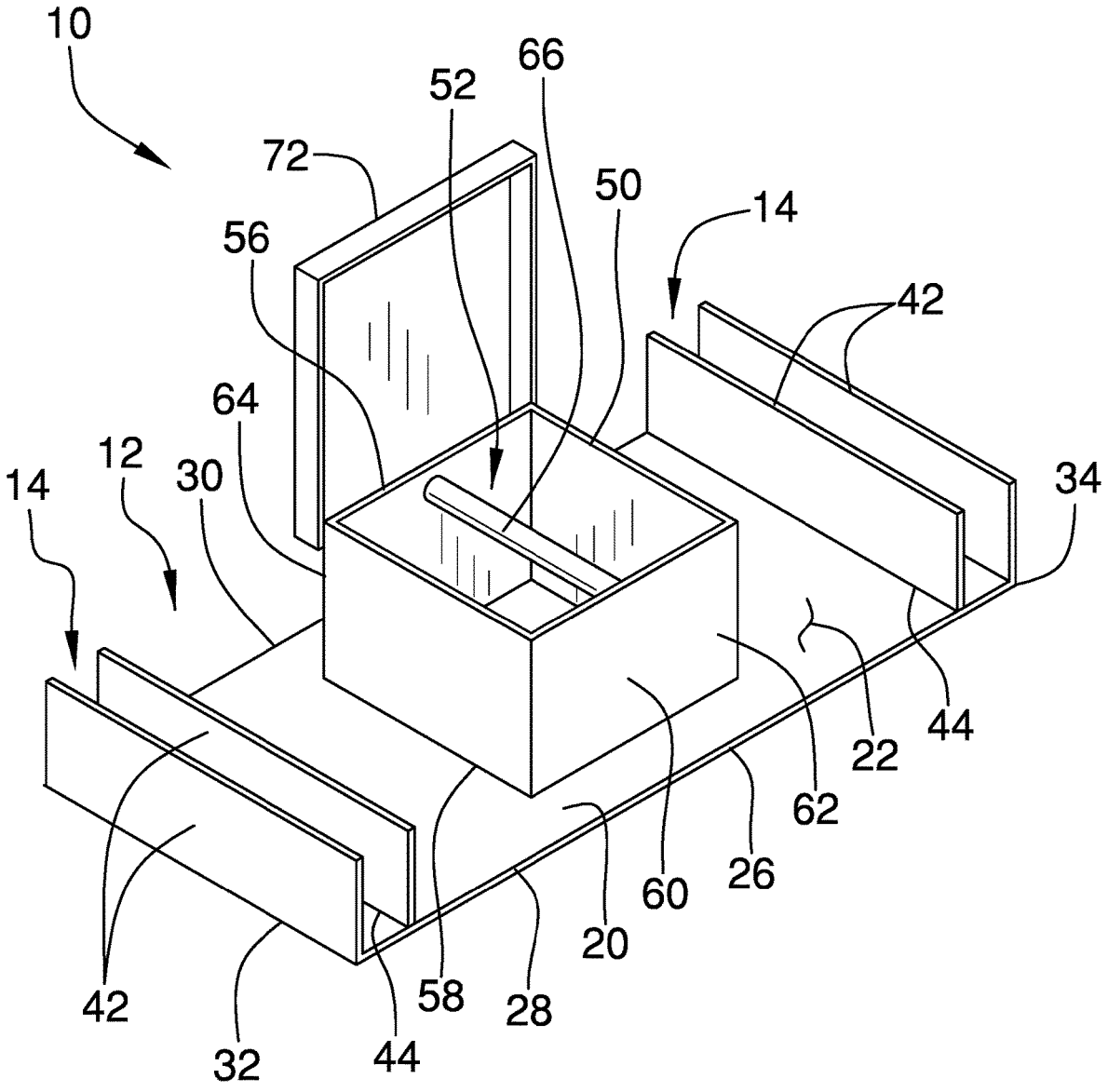
FIG. 1 is a bottom perspective view of a fall arrest assembly according to an embodiment of the disclosure.
Figure 2:
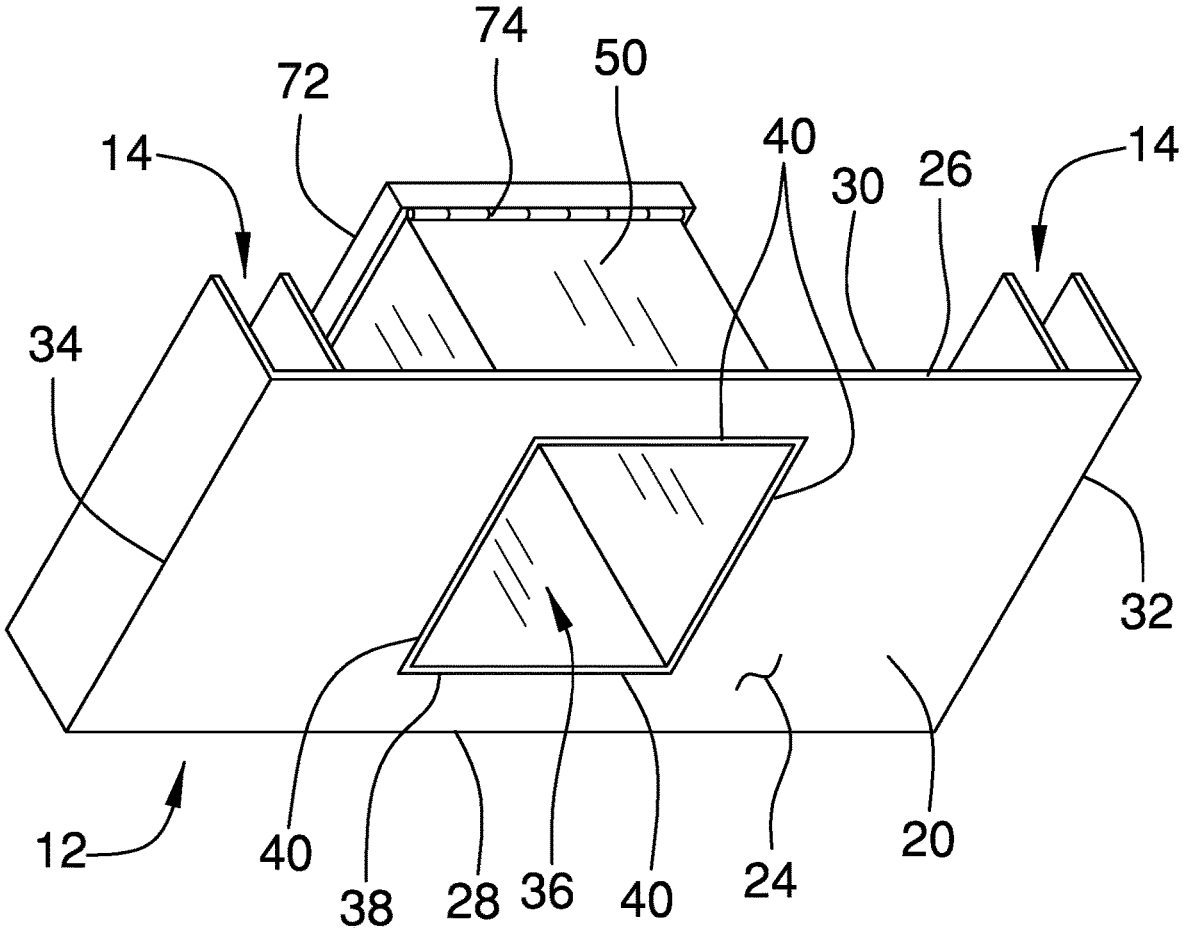
FIG. 2 is a top perspective view of an embodiment of the disclosure.
Figure 3:
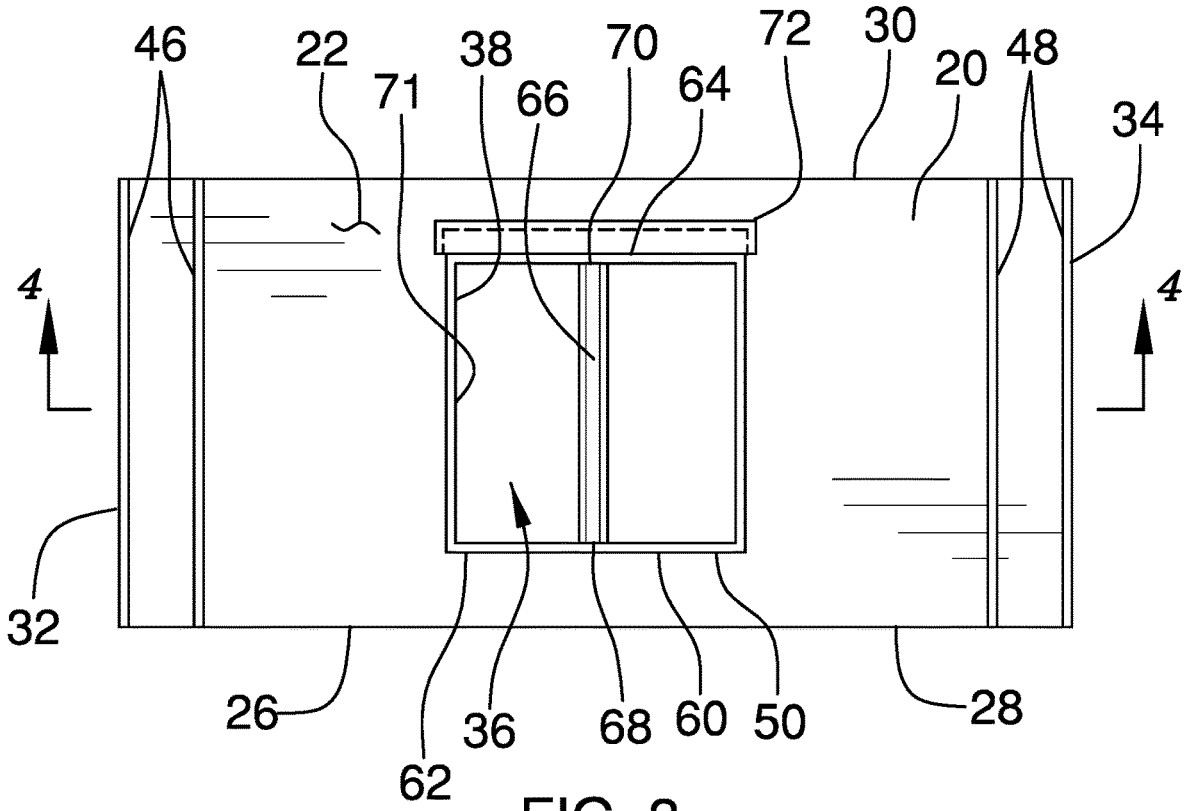
FIG. 3 is a bottom view of an embodiment of the disclosure.
Figure 4:
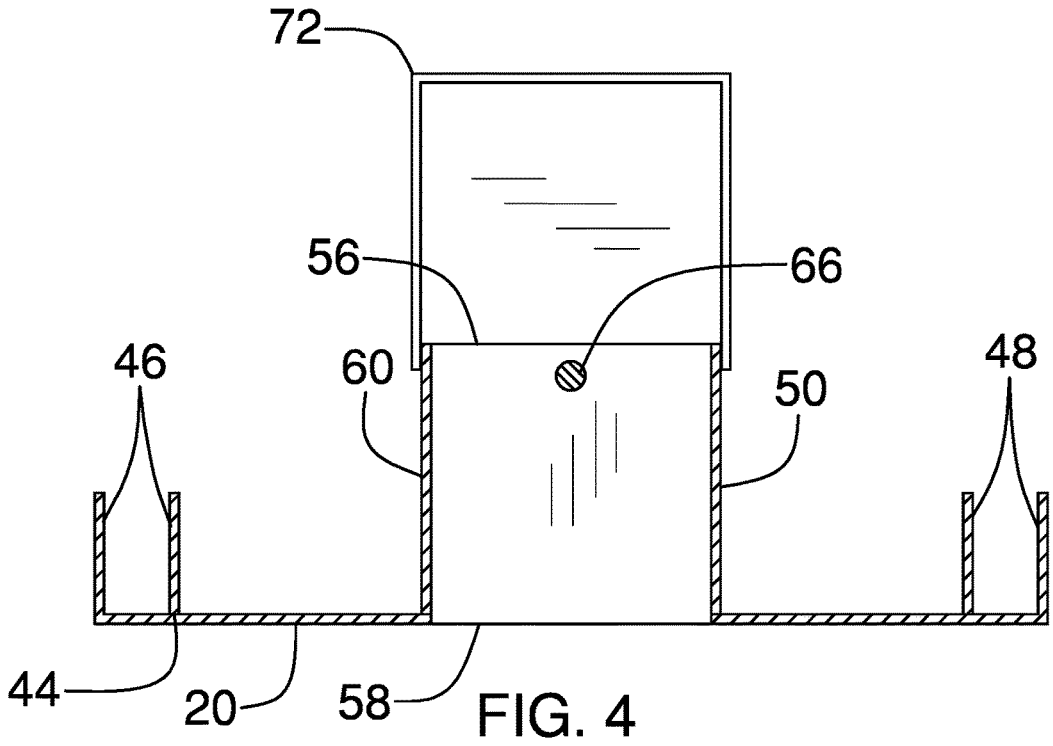
FIG. 4 is a cross sectional view taken along line 4-4 of FIG. 3 of an embodiment of the disclosure.
Figure 5:
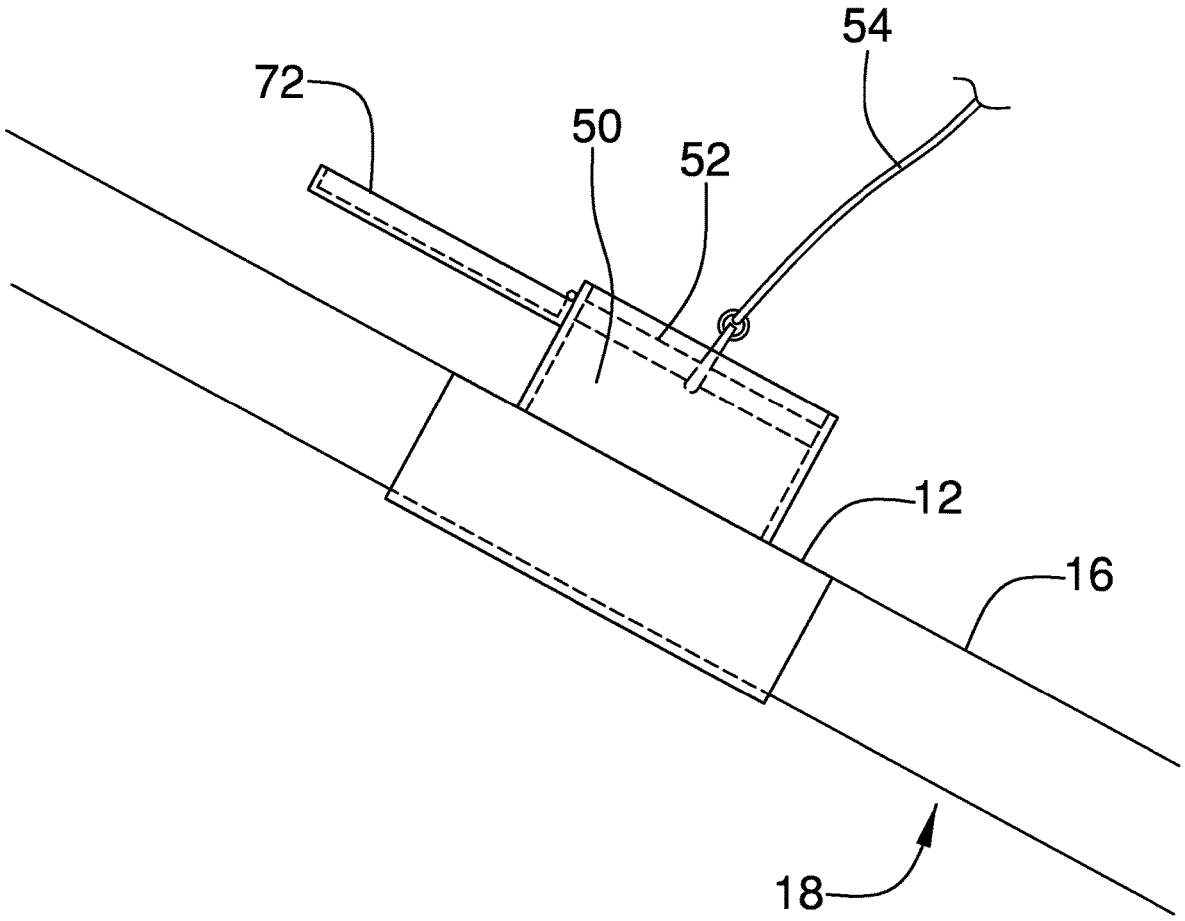
FIG. 5 is a side perspective in-use view of an embodiment of the disclosure.
Figure 6:
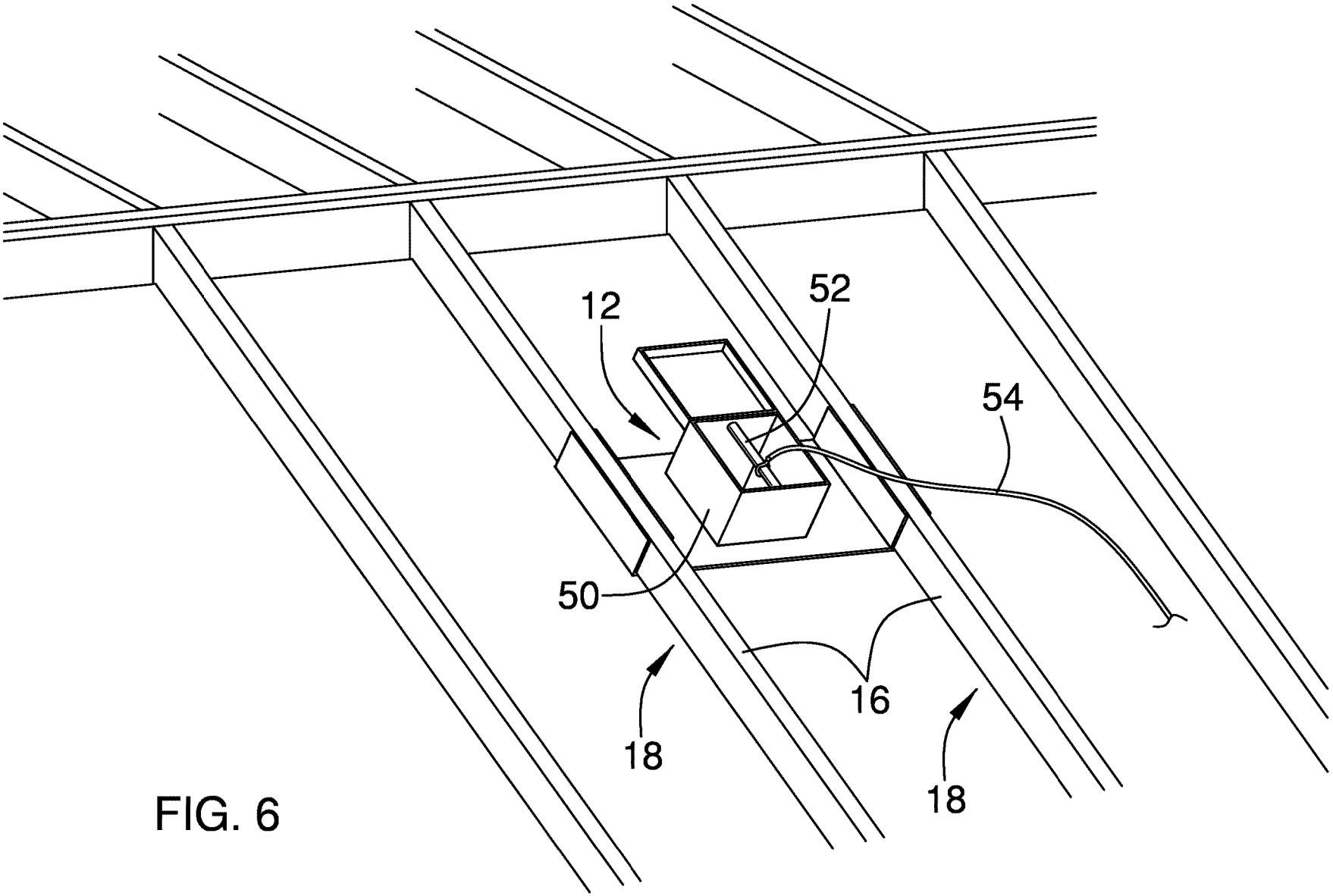
FIG. 6 is a perspective in-use view of an embodiment of the disclosure.

With reference now to the drawings, and in particular to FIGS. 1 through 6 thereof, a new fall device embodying the principles and concepts of an embodiment of the disclosure and generally designated by the reference numeral 10 will be described.

As best illustrated in FIGS. 1 through 6, the fall arrest assembly 10 generally comprises a truss mount 12 that has a pair of channels 14 each being integrated into the truss mount 12. The pair of channels 14 is oriented parallel with respect to each other. In this way each of the channels 14 can insertably receive a beam 16 of a respective one of a pair of roof trusses 18 thereby mounting the truss mount 12 to the pair of roof trusses 18. The roof trusses 18 may be roof trusses in a framed structure, such as a house or an office building. Additionally, the roof trusses 18 may be pitched roof trusses, flat roof trusses or any other conventional type of roof truss.

The truss mount 12 comprises a panel 20 that has a first surface 22, a second surface 24 and a perimeter edge 26 extending between the first surface 22 and the second surface 24, and the perimeter edge 26 has a front side 28, a back side 30, a first lateral side 32 and a second lateral side 34. The panel 20 is elongated between the first lateral side 32 and the second lateral side 34, and the panel 20 has an opening 36 extending through the first surface 22 and the second surface 24. The opening 36 is centrally positioned on the panel 20 and the opening 36 has a bounding edge 38. Furthermore, the bounding edge 38 has a plurality of perpendicularly intersecting sides 40 such that the opening 36 has a rectangular shape.

The truss mount 12 includes a plurality of walls 42 that each has a lower edge 44, and the lower edge 44 of each of the walls 42 is coupled to the first surface 22 of the panel 20. Each of the walls 42 extends between the front side 28 and the back side 30 of the perimeter edge 26. The plurality of walls 42 includes a pair of first walls 46 and a pair of second walls 48. The first walls 46 are spaced a pre-determined distance apart from each other such that each of the first walls 46 defines a respective one of the channels 14 in the truss mount 12. The second walls 48 are spaced a pre-determined distance apart from each other such that each of the second walls 48 defines a respective one of the channels 14 in the truss mount 12.

The pre-determined distance between the first walls 46 and the second walls 48 may range between approximately 3.0 inches and 4.0 inches. Furthermore, the pair of first walls 46 may be spaced from the pair of second walls 48 a distance ranging between approximately 12.0 inches and 24.0 inches thereby facilitating the channels 14 to accommodate typical roof truss spacing. A respective one of the first walls 46 is aligned with the first lateral side 32 of the perimeter edge 26 of the panel 20, and a respective one of the second walls 48 is aligned with the second lateral side 34 of the perimeter edge 26 of the panel 20.

An anchor box 50 is provided and the anchor box 50 is integrated into the truss mount 12. The anchor box 50 has an anchor point 52 which is integrated into the anchor box 50 and a fall arresting line 54 can be attached to the anchor point 52. In this way the fall arresting line 54 can be mounted to the pair of roof trusses 18. The fall arresting line 54 may be a fall arresting line of any conventional design that would commonly be employed by a construction worker, for example.

The anchor box 50 has a top side 56, a bottom side 58 and an outer wall 60 extending between the top side 56 and the bottom side 58. Each of the top side 56 and the bottom side 58 is open, and the bottom side 58 is coupled to the first surface 22 of the panel 20. The anchor box 50 is aligned with the opening 36 in the panel 20 such that the bottom side 58 is coextensive with the bounding edge 38 of the opening 36. The outer wall 60 has a forward side 62 and a rear side 64, and each of the forward side 62 and the rear side 64 is spaced from a respective one of the front side 28 and the back side 30 of the perimeter edge 26 of the panel 20.

A bar 66 is included which has a first end 68 and a second end 70, and each of the first end 68 and the second end 70 is coupled to an inside surface 71 of the outer wall 60 of the anchor box 50 such that the bar 66 defines the anchor point 52 in the anchor box 50. The bar 66 is oriented to extend between the forward side 62 and the rear side 64. Additionally, the bar 66 is oriented to extend along an axis lying on a plane that is oriented perpendicular to the first surface 22 of the panel 20. The bar 66 is positioned closer to the top side 56 of the anchor box 50 than the bottom side 58 of the anchor box 50.

A lid 72 is provided which has a rear side 74 and the rear side 74 of the lid 72 is hingedly coupled to the top side 56 of the box. The lid 72 is positionable in a closed position having the lid 72 closing the top side 56, and the lid 72 is positionable in an open position having the lid 72 exposing the top side 56. Each of the panel 20, the anchor box 50 and the bar 66 may be comprised of a rigid material, such as steel or other material of similar strength, thereby facilitating the panel 20, the anchor box 50 and the bar 66 to be capable of withstanding the forces commonly produced in fall arresting systems.

In use, the truss mount 12 is positioned at a strategic location along the respective pair of roof trusses 18 such that each of the channels 14 receives a respective one of the roof trusses 18. Furthermore, the truss mount 12 is oriented such that the anchor box 50 is directed downwardly on the roof trusses 18. The fall arresting line 54 is attached to the bar 66 in the anchor box 50. In this way a construction worker, for example, can effectively employ a fall arresting system on the roof trusses 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fall arrest assembly for facilitating an anchor point between roof trusses to anchor a fall arresting line, said assembly comprising:

a truss mount having a pair of channels each being integrated into said truss mount, said pair of channels being oriented parallel with respect to each other wherein each of said channels is configured to insertably receive a beam of a respective one of a pair of roof trusses thereby mounting said truss mount to the pair of roof trusses;

an anchor box being integrated into said truss mount, said anchor box having an anchor point being integrated into said anchor box wherein said anchor point is configured to have a fall arresting line being attached to said anchor point thereby facilitating the fall arresting line to be mounted to the pair of roof trusses;

wherein said truss mount comprises a panel having a first surface, a second surface and a perimeter edge extending between said first surface and said second surface, said perimeter edge having a front side, a back side, a first lateral side and a second lateral side, said panel being elongated between said first lateral side and said second lateral side;

wherein said panel has an opening extending through said first surface and said second surface, said opening being centrally positioned on said panel; and wherein said opening has a bounding edge, said bounding edge having a plurality of perpendicularly intersecting sides such that said opening has a rectangular shape.

2. The assembly according to claim 1, wherein said truss mount includes a plurality of walls, each of said walls having a lower edge, said lower edge of each of said walls being coupled to said first surface of said panel, each of said walls extending between said front side and said back side of said perimeter edge.

3. The assembly according to claim 2, wherein said plurality of walls includes a pair of first walls and a pair of second walls, said first walls being spaced a pre-determined distance apart from each other such that each of said first walls defines a respective one of said channels in said truss mount, said second walls being spaced a pre-determined distance apart from each other such that each of said second walls defines a respective one of said channels in said truss mount.

4. The assembly according to claim 3, wherein a respective one of said first walls is aligned with said first lateral side of said perimeter edge of said panel, a respective one of said second walls being aligned with said second lateral side of said perimeter edge of said panel.

5. The assembly according to claim 2, wherein:

said anchor box has a top side, a bottom side and an outer wall extending between said top side and said bottom side, each of said top side and said bottom side being open, said bottom side being coupled to said first surface of said panel;

said anchor box being aligned with said opening in said panel such that said bottom side is coextensive with said bounding edge of said opening;

said outer wall has a forward side and a rear side, each of said forward side and said rear side being spaced from a respective one of said front side and said back side of said perimeter edge of said panel.

6. The assembly according to claim 5, further comprising a bar having a first end and a second end, each of said first end and said second end being coupled to an inside surface of said outer wall of said anchor box such that said bar defines said anchor point in said anchor box.

7. The assembly according to claim 6, wherein said bar is oriented to extend between said forward side and said rear side.

8. The assembly according to claim 6, wherein said bar is oriented to extend along an axis lying on a plane being oriented perpendicular to said first surface of said panel.

9. The assembly according to claim 6, wherein said bar is positioned closer to said top side of said anchor box than said bottom side of said anchor box.

10. The assembly according to claim 5, further comprising a lid having a rear side, said rear side being hingedly coupled to said top side of said box, said lid being positionable in a closed position having said lid closing said top side, said lid being positionable in an open position having said lid exposing said top side.

11. A fall arrest assembly for facilitating an anchor point between roof trusses to anchor a fall arresting line, said assembly comprising:

a truss mount having a pair of channels each being integrated into said truss mount, said pair of channels being oriented parallel with respect to each other wherein each of said channels is configured to insertably receive a beam of a respective one of a pair of roof trusses thereby mounting said truss mount to the pair of roof trusses, said truss mount comprising:

a panel having a first surface, a second surface and a perimeter edge extending between said first surface and said second surface, said perimeter edge having a front side, a back side, a first lateral side and a second lateral side, said panel being elongated between said first lateral side and said second lateral side, said panel having an opening extending through said first surface and said second surface, said opening being centrally positioned on said panel, said opening having a bounding edge, said bounding edge having a plurality of perpendicularly intersecting sides such that said opening has a rectangular shape; and a plurality of walls, each of said walls having a lower edge, said lower edge of each of said walls being coupled to said first surface of said panel, each of said walls extending between said front side and said back side of said perimeter edge, said plurality of walls including a pair of first walls and a pair of second walls, said first walls being spaced a pre-determined distance apart from each other such that each of said first walls defines a respective one of said channels in said truss mount, said second walls being spaced a pre-determined distance apart from each other such that each of said second walls defines a respective one of said channels in said truss mount, a respective one of said first walls being aligned with said first lateral side of said perimeter edge of said panel, a respective one of said second walls being aligned with said second lateral side of said perimeter edge of said panel; and an anchor box being integrated into said truss mount, said anchor box having an anchor point being integrated into said anchor box wherein said anchor point is configured to have a fall arresting line being attached to said anchor point thereby facilitating the fall arresting line to be mounted to the pair of roof trusses, said anchor box having a top side, a bottom side and an outer wall extending between said top side and said bottom side, each of said top side and said bottom side being open, said bottom side being coupled to said first surface of said panel, said anchor box being aligned with said opening in said panel such that said bottom side is coextensive with said bounding edge of said opening, said outer wall having a forward side and a rear side, each of said forward side and said rear side being spaced from a respective one of said front side and said back side of said perimeter edge of said panel;

a bar having a first end and a second end, each of said first end and said second end being coupled to an inside surface of said outer wall of said anchor box such that said bar defines said anchor point in said anchor box, said bar being oriented to extend between said forward side and said rear side, said bar being oriented to extend along an axis lying on a plane being oriented perpendicular to said first surface of said panel, said bar being positioned closer to said top side of said anchor box than said bottom side of said anchor box; and a lid having a rear side, said rear side being hingedly coupled to said top side of said box, said lid being positionable in a closed position having said lid closing said top side, said lid being positionable in an open position having said lid exposing said top side.

* * * * *